US006632111B2

(12) United States Patent
Oathout

(10) Patent No.: US 6,632,111 B2
(45) Date of Patent: Oct. 14, 2003

(54) PADDLE SUPPORT FOR A VESSEL

(76) Inventor: David E. Oathout, 129 Fulton Rd., Caroga Lake, NY (US) 12032

( * ) Notice: Subject to any disclaimer, the term of this patent is extended or adjusted under 35 U.S.C. 154(b) by 0 days.

(21) Appl. No.: 09/934,676

(22) Filed: Aug. 23, 2001

(65) Prior Publication Data

US 2003/0040234 A1 Feb. 27, 2003

(51) Int. Cl.[7] ..... B63H 16/06
(52) U.S. Cl. ..... 440/104; 440/107; 114/364
(58) Field of Search ..... 440/104, 101–103, 440/105–110; 114/364, 343; 416/74, 69; D12/215

(56) References Cited

U.S. PATENT DOCUMENTS

| | | | | | |
|---|---|---|---|---|---|
| 88,013 | A | | 3/1869 | Connor | |
| 287,088 | A | | 10/1883 | Beckers | |
| 421,806 | A | * | 2/1890 | Bailey | 440/104 |
| 468,960 | A | | 2/1892 | Vondersaar | |
| 2,033,637 | A | | 3/1936 | Kaiser | |
| 2,083,004 | A | * | 6/1937 | Clark | 440/104 |
| 2,550,625 | A | * | 4/1951 | Vick | 440/104 |
| 2,815,517 | A | * | 12/1957 | Andresen Jr. | 440/104 |
| 3,898,950 | A | * | 8/1975 | Martin | 114/363 |
| 4,380,208 | A | * | 4/1983 | Goserud | 114/363 |
| 4,516,941 | A | * | 5/1985 | Reid | 440/105 |
| 4,595,373 | A | * | 6/1986 | Giroux | 440/104 |
| 4,649,852 | A | * | 3/1987 | Piantedosi | 114/363 |
| 4,659,125 | A | | 4/1987 | Chuan | |
| 4,672,911 | A | * | 6/1987 | Hodgins | 114/363 |
| 4,856,929 | A | | 8/1989 | Smahlik et al. | |
| 5,059,145 | A | | 10/1991 | Gregg | |
| 5,127,859 | A | | 7/1992 | Rantilla | |
| 5,215,482 | A | | 6/1993 | Henry | |
| 5,435,093 | A | * | 7/1995 | Minorics et al. | 43/19.2 |
| 5,595,517 | A | | 1/1997 | Smith | |
| 5,647,782 | A | | 7/1997 | Henry | |
| 5,685,750 | A | | 11/1997 | Rantilla | |
| 5,975,004 | A | * | 11/1999 | Nesseth | 114/347 |
| 6,022,255 | A | | 2/2000 | Lukanovich | |
| 6,083,066 | A | | 7/2000 | Wright | |
| 6,095,878 | A | * | 8/2000 | Van Balen | 440/105 |
| 6,183,325 | B1 | * | 2/2001 | Purser | 440/106 |

FOREIGN PATENT DOCUMENTS

| | | | | |
|---|---|---|---|---|
| AT | 166561 | * | 7/1948 | 440/102 |
| CH | 123262 | * | 11/1927 | 440/104 |
| DE | 164046 | * | 10/1905 | 440/104 |
| DE | 572423 | * | 2/1933 | 440/104 |
| DE | 3415483 | * | 10/1985 | 440/101 |
| FR | 2589125 | * | 4/1987 | 440/104 |
| GB | 6872 | * | 4/1893 | 440/102 |
| GB | 10242 | * | 5/1907 | 440/104 |
| GB | 304095 | * | 1/1929 | 440/104 |
| IT | 451657 | * | 9/1949 | 440/102 |
| NL | 8701897 | * | 3/1989 | 440/101 |
| NO | 72278 | * | 8/1946 | 440/106 |

* cited by examiner

*Primary Examiner*—S. Joseph Morano
*Assistant Examiner*—Ajay Vasudeva
(74) *Attorney, Agent, or Firm*—Oliff & Berridge, PLC

(57) ABSTRACT

A paddle support assists in rowing a vessel. The paddle is retained in the upper portion of a support that has a base section that rests, preferably unattached or at least readily releasably attached on the floor of a vessel. The support allows the paddle to be freely manipulated unencumbered by attachments to the vessel. The paddle support may be attached to webbing suspended across an opening in the vessel so that a base of the support is attached near the center of the webbing. The paddle support may also be attached to a harness suspended across an opening in the vessel so that the upright support is attached near the center of the harness. The use of the webbing or harness facilitates use of the support with a watertight skirt or covering stretched over the opening of a vessel.

33 Claims, 14 Drawing Sheets

PADDLE SUPPORT FOR A VESSEL

BACKGROUND OF THE INVENTION

1. Field of Invention

This invention relates to a paddle support for a vessel to allow a rower to rest a paddle while rowing a vessel or at rest.

2. Description of Related Art

The use of paddle supports and oar locks to assist in rowing a vessel is well known in the prior art. Typically, these devices provide support for an oar or paddle and may also provide leverage to the rower during operation. These devices may be attached to the outer hull of a vessel, or they may be mounted on the floor of the vessel with a post that extends upward to engage a paddle or an oar at a height which facilitates the individual rower.

SUMMARY OF THE INVENTION

Paddle supports can be removably or permanently attached to a vessel during operation. This requires the paddle to be fixed in a position prior to operation. While this may provide the rower with both leverage and support, it also restricts his range of motion when manipulating the paddle. If a rower accidentally removes the paddle from the support he must direct his time and attention to returning the paddle to the operating position within the support. Thus, these devices require the rower to make a conscious effort to return the paddle to the support before rowing may continue.

In addition, these devices do not allow the rower to reposition the support laterally without either removing and reattaching the support or making some other type of adjustment. Further, a rower may find it necessary from time to time to push the vessel away from fixed objects such as rocks or piers, or to push debris away from the vessel itself. In these situations, the necessity to remove and replace the paddle in the support may become problematic. This may be especially so when the vessel is moving rapidly through areas with many fixed objects, i.e., areas of rivers and streams containing rapids. In these situations, the ability of the rower to quickly and freely manipulate the paddle may be crucial in preventing injury to the rower as well as damage to the vessel.

This invention provides an apparatus and method for supporting a paddle during operation of a vessel. The paddle support of this invention utilizes a free standing support section that is removably attached to the paddle. The paddle support need not be attached to the vessel. This allows the rower to manipulate the paddle freely with the support attached. The paddle support is made up of a retainer at the top portion for retaining the paddle, an upright support section that may be adjusted or set to a proper height to facilitate the rower and a base section that rests freely on the floor of the vessel. This arrangement allows the support to be manipulated laterally to facilitate the comfort of the rower and allows the paddle to be lifted vertically by the rower without encumbrances. This is especially advantageous in situations involving fast moving water, such as rapids, in that the rower can quickly manipulate the paddle to push off of rocks and obstructions, returning just as quickly to rowing the vessel.

The paddle support of this invention may be adjusted in height to facilitate the comfort of the individual rower. This aides in reducing arm fatigue, by allowing the rower to operate the paddle in a range of motion which is most comfortable. It also allows the rower to rest the weight of the paddle and the rower's arms on the support during periods when the vessel is not being actively rowed.

In vessels such as canoes and kayaks, a rower may use a skirt to prevent water from entering the vessel. Typically, the skirt would cover the area between the rower's body and the edge of the inside of the vessel; for example, the exposed cockpit area of a kayak. The paddle supports of the prior art are not particularly conducive for use with a skirt, because the support must either be attached a considerable distance from the rower's body, or must penetrate the skirt itself, creating a point where water may enter the vessel. In addition, because the supports of the prior art are in a fixed position and attached to the vessel itself, there is greater possibility of injury to the rower when operating in rough water conditions. One embodiment of the current invention alleviates this condition, allowing for use of the paddle support with a skirt. In this embodiment, a piece of webbing is removably attached to the outer hull of the vessel extending across the opening covered by the skirt in front of the rower. The upright support portion of the paddle support is then attached to the webbing at the center portion of the vessel opening. The webbing is maintained in tension over the opening by the force exerted by the rower's arms, paddle and support itself bearing down on the center of the webbing. In this way the support may be maintained close to the rower's body without interfering with the water tight skirt. The height of the support may be varied by manipulating the upright support section itself or by adjusting the overall length of the webbing suspended over the opening. In another embodiment, a harness made up of one or more flexible plates may be utilized in lieu of webbing to extend across the vessel opening and hold the upright support in place. Lastly, the apparatus and method of this invention allows for easy removal and storage of the paddle support. This in turn, facilitates the easy handling and transporting of the vessel, in that the entire paddle support apparatus is removed from the vessel leaving no outward projections which could hinder mounting and transporting on a vehicle.

These and other features and advantages of this invention are described in, or are apparent from, the following detailed description of the preferred embodiments.

BRIEF DESCRIPTION OF THE DRAWINGS

The invention will be described with reference to the accompanying drawings in which like elements are labeled with like numbers and in which.

DETAILED DESCRIPTION OF PREFERRED EMBODIMENTS

Figure 1:
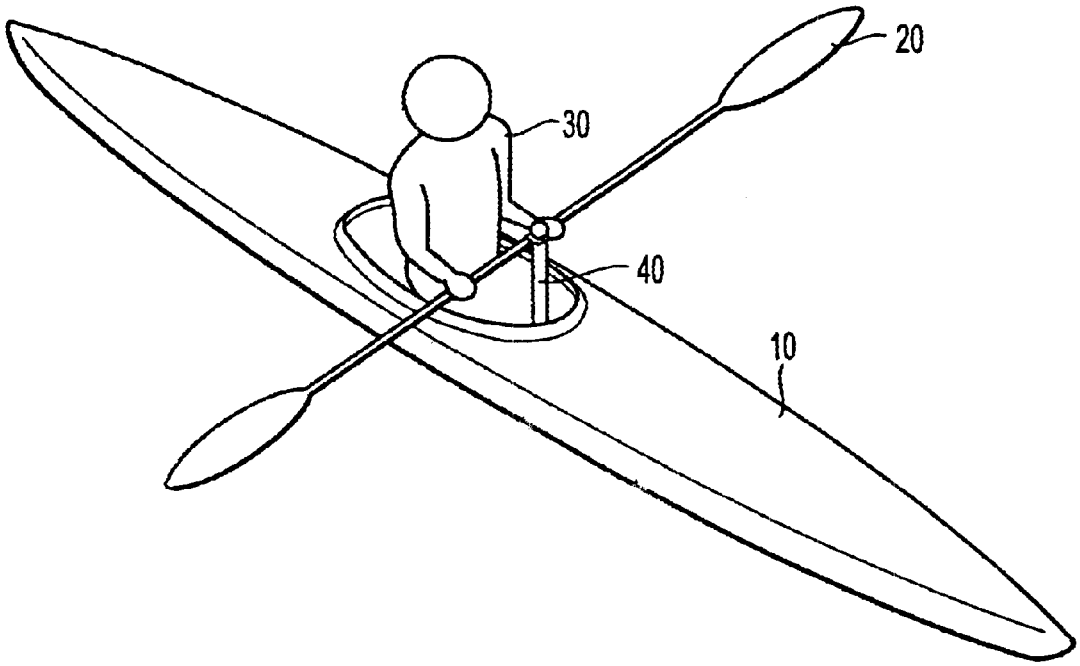
FIG. 1 shows an exemplary embodiment of a typical vessel with rower, paddle and paddle support according to this invention.

FIG. 1 shows a paddle support 40 in use. The paddle support 40 is located in a vessel 10 with a paddle 20 mounted on the upper portion of the paddle support 40. The rower 30 may manipulate the paddle 20 in a full range of operational motion while resting the weight of the paddle 20 and the rower's arms on the paddle support which ultimately transmits the load to the base of the vessel.

Figure 2:
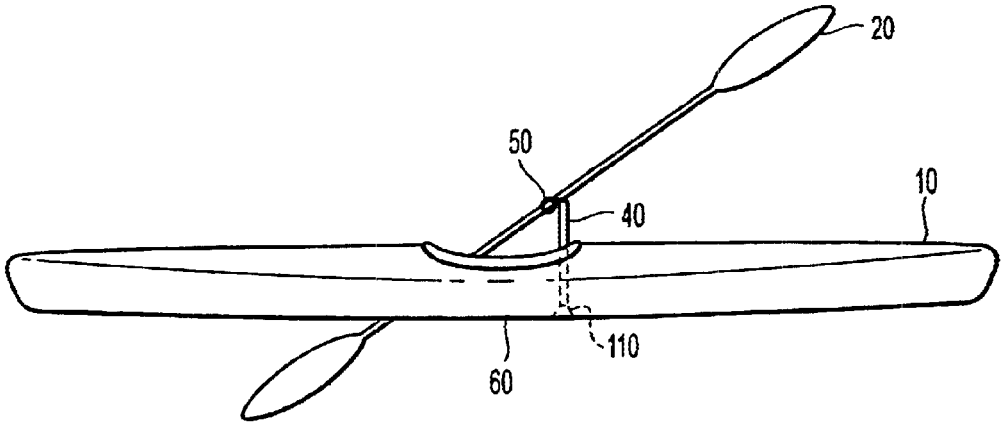
FIG. 2 is another exemplary embodiment of a vessel, paddle and paddle support of this invention.

FIG. 2 is a longitudinal view of a typical vessel 10 with the paddle support 40 shown in place. The paddle 20 is mounted to the top of the paddle support 40 by a retainer 50 at the upper portion of the support 40. The support 40 has a base member 110 that rests freely on the bottom of the vessel 60. In this embodiment the paddle support 40 is not attached to the vessel in any way. This allows the rower the freedom to manipulate the paddle 20 with paddle support 40 connected in any way necessary without the encumbrance of having the paddle 20 physically attached to the vessel 10. Those skilled in the art recognize that the support 40 may be used with a wide variety of vessels and is not limited to the vessel shown.

Figure 3A:
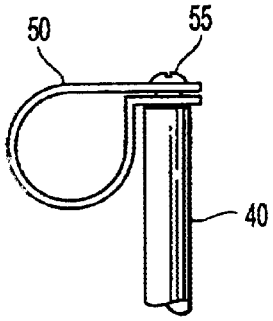
FIG. 3A is a cross-sectional view of an embodiment of a retainer for fixing the paddle on the upper portion of the support.

FIG. 3A shows a typical embodiment of a retainer 50 having a retainer screw 55 which fixes the retainer 50 to the top of the support 40. In the preferred embodiment the retainer 50 is of a flexible material that fits around the paddle 20 allowing the paddle to rotate about the point that is fixed by the retainer 50. The fit between the retainer and paddle is sufficiently lose to allow the paddle to rotate about its longitudinal axis. In this way a rower may rotate the paddle in an effort to lower wind resistance when the paddle is out of the water. The paddle 20 may be installed in the retainer by removing the retainer screw 55, placing the paddle in the retainer 50 and then reinstalling the screw 55 until the paddle 20 is held snugly in place.

Figure 3B:
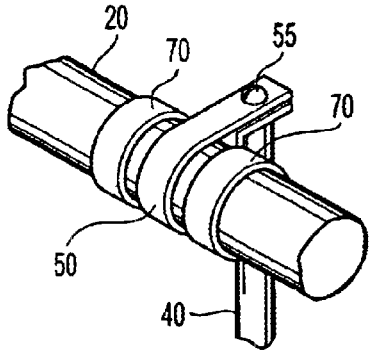
FIG. 3B is a perspective view of another exemplary embodiment of the retainer having a center section of the paddle in place with two clamp retainers on either side of the retainer to prevent lateral movement of the paddle.

FIG. 3B is a typical embodiment of a retainer 50 showing a section of the paddle 20 in place. The paddle 20 is mounted within the retainer 50 and held in place by the retainer screw 55 which is mounted on the paddle support 40. In this embodiment retainer clamps 70 are in place on the paddle 20 on either side of the retainer 50 to prevent lateral motion of the paddle 20 within the retainer 50. This allows the rower to maintain greater control over the paddle 20 while in use. The retainer clamps 70 may be of a rigid or flexible material and held in place with the use of screws or clips, or they may be permanently affixed to the paddle 20 by an adhesive. One skilled in the art will recognize that the paddle may be prevented from moving laterally in the retainer by various other means. For example, the retainer 50 may be permanently affixed to the paddle 20 by a screw or a clip.

Figure 3C:
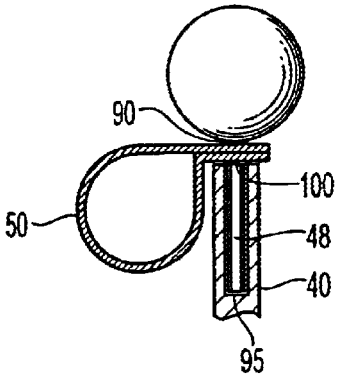
FIG. 3C is a cross-sectional view of an exemplary embodiment of a retainer having a ball and pin quick release mechanism.

FIG. 3C is another embodiment of the retainer 50 of this invention having a removable pin and ball arrangement for the quick placement and removal of the paddle 20 from the support 40. The retainer 50 is held in place on top of the support 40 by a ball 80 having a pin 48 that inserts in a support hole 95. This embodiment allows the rower to place the paddle 20 in the retainer 50 without the use of any tools. The paddle 20 is put in place by opening the retainer 50, placing the paddle 20 in the retainer 50 aligning the upper and lower retainer holes 90 and 100 over the support hole 48 and placing the pin 95 through the holes 90 and 100 into the support hole 95. In this embodiment the ball 80 is of a plastic or other hard material. However, in other embodiments the ball 80 may be used to house or mount other useful items such as a compass, clock, or light.

Figure 3D:
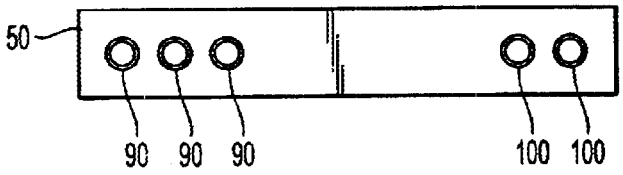
FIG. 3D is an embodiment of the retainer in an opened position illustrating the mounting holes for fixing the retainer on top of the upright support.

FIG. 3D shows a typical retainer 50 of this invention having lower retainer holes 100 and upper retaining holes 90 for fixing the paddle in the retainer 50 and the retainer 50 on the upper support 40. The upper support holes 90 allow for adjustment of the retainer 50 to accommodate a paddle 20 of varying shaft diameters, and also to adjust the range of motion of the paddle 20.

Figure 4A:
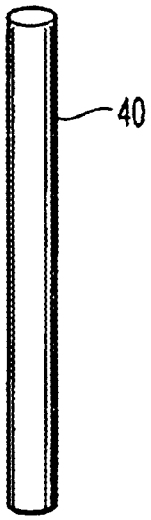
FIG. 4A is an exemplary embodiment of an upright support.

FIG. 4A is a typical support 40 of this invention. The support 40 of this invention acts in a similar manner to a crutch, in that it is not connected to the base of the Kayak in any way. The retainer 50 is mounted at the top of the support 40 and a base 110 is mounted at the bottom of the support 40. The support of this embodiment is of a fixed height and is not adjustable.

Figure 4B:
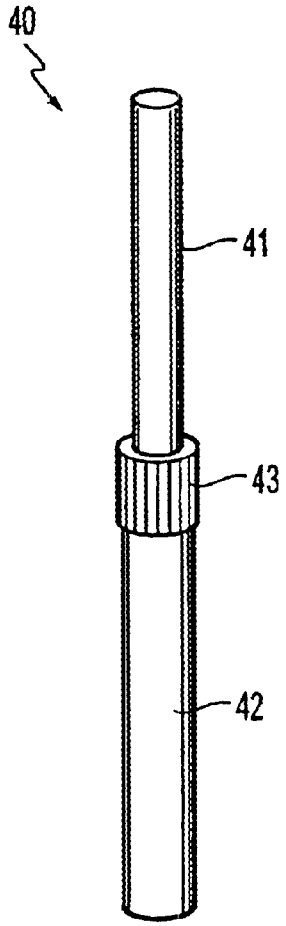
FIG. 4B is another exemplary embodiment of an upright support having telescoping sections that may be adjusted to a desired height.

FIG. 4B shows an embodiment of an adjustable support of this invention having an upper support section 41 telescopically connected to a lower support section 42 for adjusting the overall height of the support 40. The upper support section 41 is fixed in place in relation to the lower support section 42 by an adjusting ring 43 which is rotated to lock the upper support 41 and lower support 42 in place. This embodiment of the support 40 allows the rower to quickly and easily adjust the overall height of support prior to, or during use.

Figure 4C:
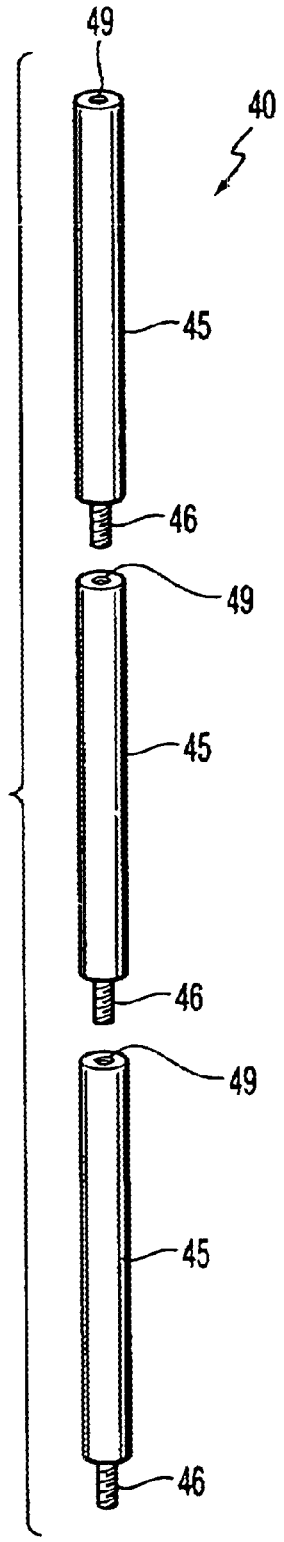
FIG. 4C is another exemplary embodiment of the upright support having individual sections that can be removed to adjust the height of the support.

FIG. 4C is another embodiment of the support 40 of this invention having removable individual modular sections 45. Each section has a threaded male connection 46 which may be inserted into a corresponding threaded female connection 49. In this embodiment the support sections 45 may be removed or replaced to suit a comfortable support height for the rower. When the desired number of individual sections 45 have been assembled a base 110 may be mounted on the male connector 46 and the retainer 50 may be mounted via the female connector 49 on the upper most individual support 45. While this embodiment uses threaded male and female connectors 46 and 49, one skilled in the art will recognize that various other types of connectors may be utilized between the individual support sections 45. For example, a post and hole arrangement may be used relying on an interference fit between the post and hole to connect the supports, or various other quick release type fittings could be utilized to accomplish the same result.

Figure 4D:
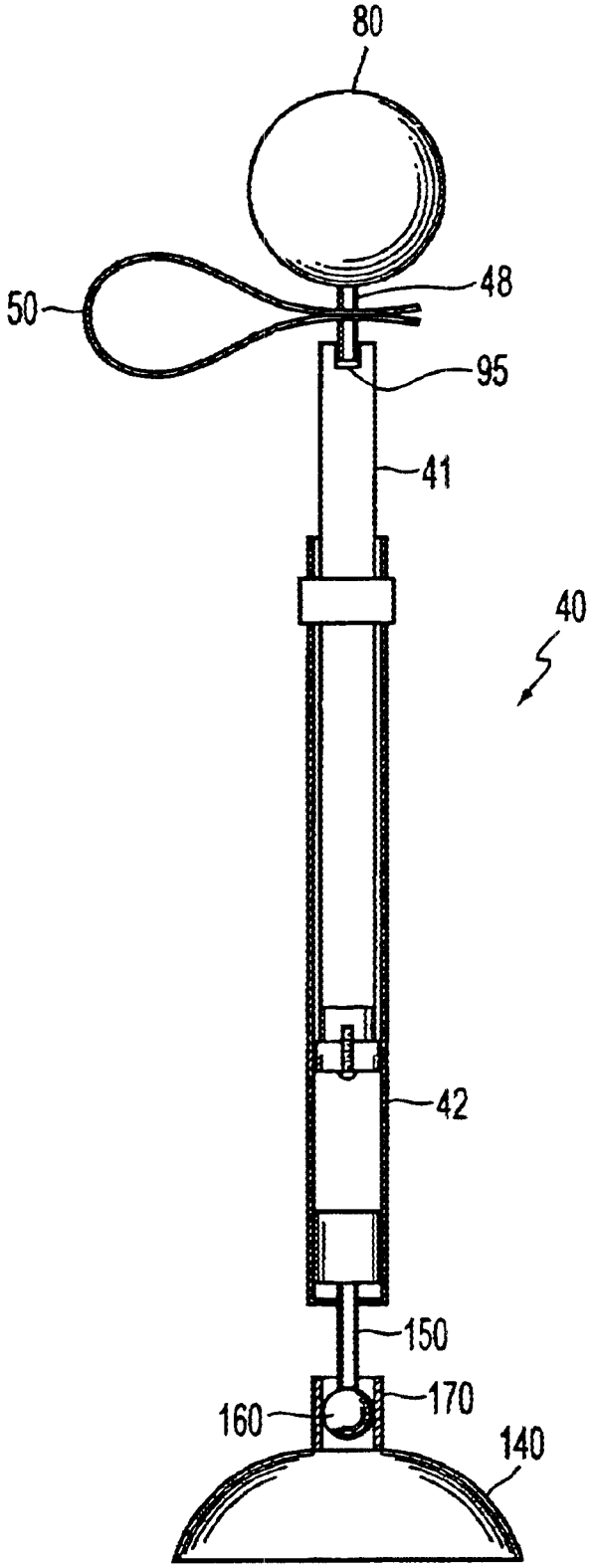
FIG. 4D is an exemplary embodiment of a fully assembled paddle support having a retainer with quick release ball and pin, an adjustable upright support and suction cup base.

FIG. 4D is an exemplary embodiment of a fully assembled paddle support of this invention. The support 40 of this embodiment is adjustable having an upper support section 41 telescopically connected to a lower support section 42 for adjusting the overall height of the support 40. The retainer 50 is held is place on top of the support 40 by a ball 80 having a pin 48 that inserts in a support hole 95. The lower portion of the support 40 is connected to the suction cup base 140 via a swiveling base connection having a ball 160 connected to a shaft 150 that connects to the support 40. The ball is inserted into a retainer cylinder 170 that is mounted on a suction cup base 140.

Figure 5A:
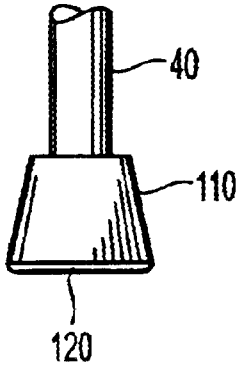
FIG. 5A is an exemplary embodiment of the base of the support.

FIG. 5A is an exemplary embodiment of a base portion for the paddle support. The base 110 has a base cushion 120 of soft or deformable material, such as rubber or foam for making contact with the bottom portion of the vessel. The base cushion prevents the base from freely sliding on the bottom portion of the vessel, while also preventing damage to the vessel. The base is not connected to the shell of the vessel in any way. The support 40 may be removably attached to the base 110 by a threaded male and female connection.

Figure 5B:
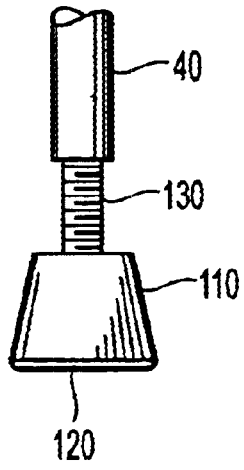
FIG. 5B is another exemplary embodiment with a base of the support having an extended threaded portion for adjusting the overall height of the paddle support.

FIG. 5B is another embodiment of a base section for the paddle support of this invention having a base 110 with a cushion support 120 connected to the support 40 by a variable height threaded connection 130. In this embodiment the threaded connection 130 allows the user to also adjust the total height of the support by extending the elongated threaded connection 130. In this way the user may make minor corrections in height without adding additional support sections or making other adjustments.

Figure 5C:
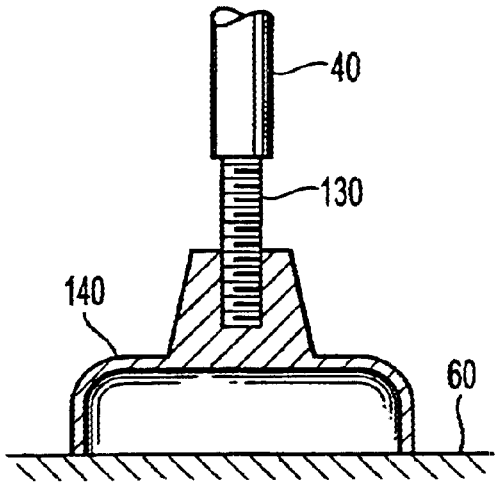
FIG. 5C is another exemplary embodiment of the base of the support having a suction cup to maintain contact with the bottom of the vessel.

FIG. 5C is an exemplary embodiment of a suction cup base 140 connected to support section 40 for making contact with the bottom of the vessel 60. The support 40 may be connected to the suction cup 140 by an elongated threaded connection 130 for making minor height adjustments in the support. As discussed previously, other means for connecting the support 40 with a base section may be utilized. In this embodiment the suction cup 140 provides the rower with the ability to temporarily fix the paddle support to the bottom of the vessel yet still be able to remove the paddle and paddle support with a moderate amount of force when necessary. In addition, due to the flexible nature of the suction cup 140 the rower is provided the further advantage of being able to rotate the support 40 about the fixed point of the suction cup, allowing lateral movement of the paddle.

Figure 5D:
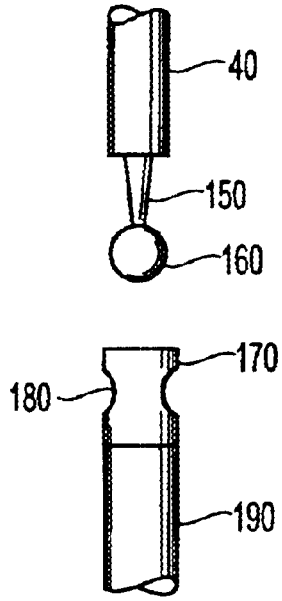
FIG. 5D is an exemplary embodiment of a swiveling base connection having a ball and socket type arrangement.

FIG. 5D is an embodiment of a swiveling base connection for connecting the support 40 to a base section having a ball 160 connected to a shaft 150 that connects to the support 40. The ball is inserted into a retainer cylinder 170 having retention holes 180. The retainer cylinder 170 is mounted to a variable base fitting 190 which may then be connected to a base section. The ball 160 is removably connected to the retention cylinder by an interference fit, thus allowing the support 40 to rotate, ultimately allowing lateral motion of the paddle 20.

Figure 6A:
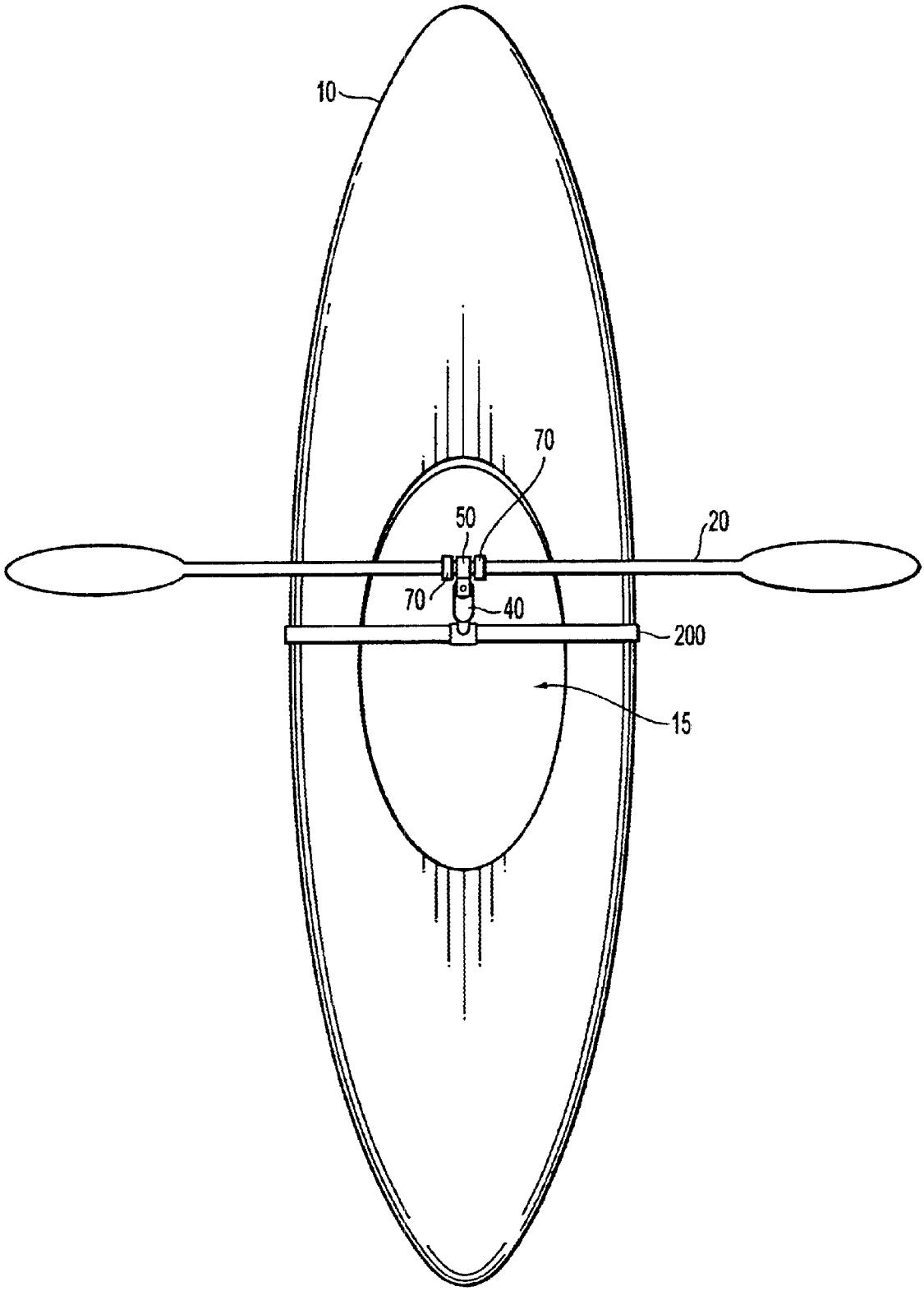
FIG. 6A is an exemplary embodiment of the paddle support of this invention having webbing attached to the outside edge of a typical vessel.

FIG. 6A is an exemplary embodiment of the paddle support of this invention having webbing 200 attached to the outer edge of the vessel 10. The support 40 is mounted to the center of the webbing, thus suspending the support over the opening of the vessel 10. The paddle 20 is mounted on the support via retainer 50 and is prevented from moving laterally by retainer clamps 70 which are in place on either side of the retainer 50.

Figure 6B:
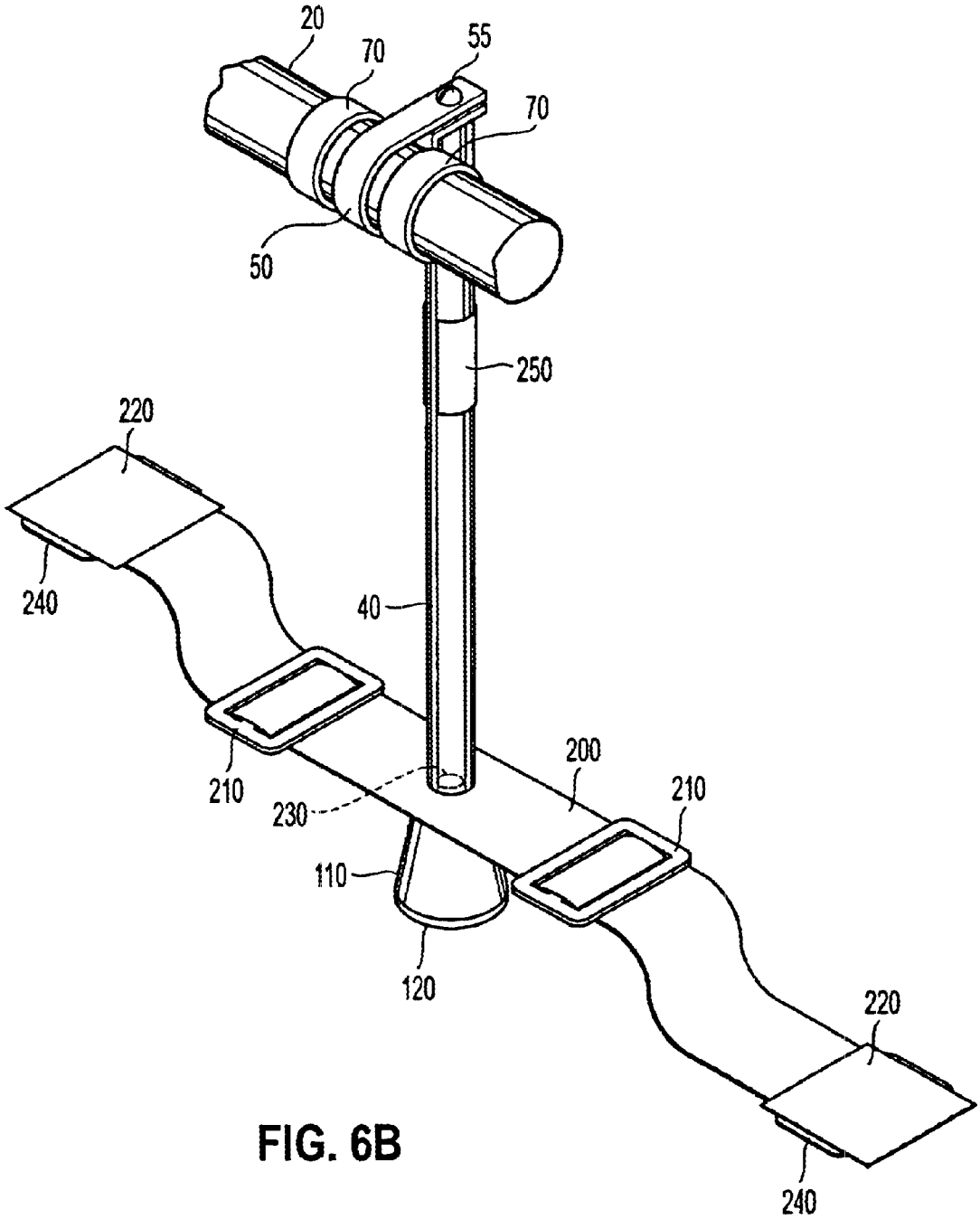
FIG. 6B is an exemplary embodiment of the paddle support of this invention having webbing attached at the base of the support for suspending the device over the opening of a vessel.

FIG. 6B is an exemplary embodiment of the paddle support of this invention having webbing 200 attached between the base 110 and the support 40 through a hole 230. The webbing 200 is adjustable in length by utilizing two adjustment buckles 210. At the outer ends of the webbing there are two secondary adjustment buckles 240 connected to velcro hook and loop fastener systems 220. The velcro hook and loop fastener systems 220 are utilized to attach the webbing to the outer hull of the vessel 10. There is an additional velcro attachment 250 at the upper portion of the support 40 for holding the webbing in place when not being utilized. The webbing 200 allows the paddle support to operate without the base 110 touching the bottom of the vessel. This is especially useful when the rower is utilizing a skirt in conjunction with an opening of a kayak to prevent water from entering the kayak. In this situation it is not necessary for the base 110 to rest on the bottom of the vessel 10 as the load of the paddle 20 and paddle support of this invention will be transferred to the webbing, which is attached to the outer hull of the vessel 10. Additionally, the height of the support may be adjusted with the use of the buckles 210 to arrive at a comfortable height for the rower.

Figure 6C:
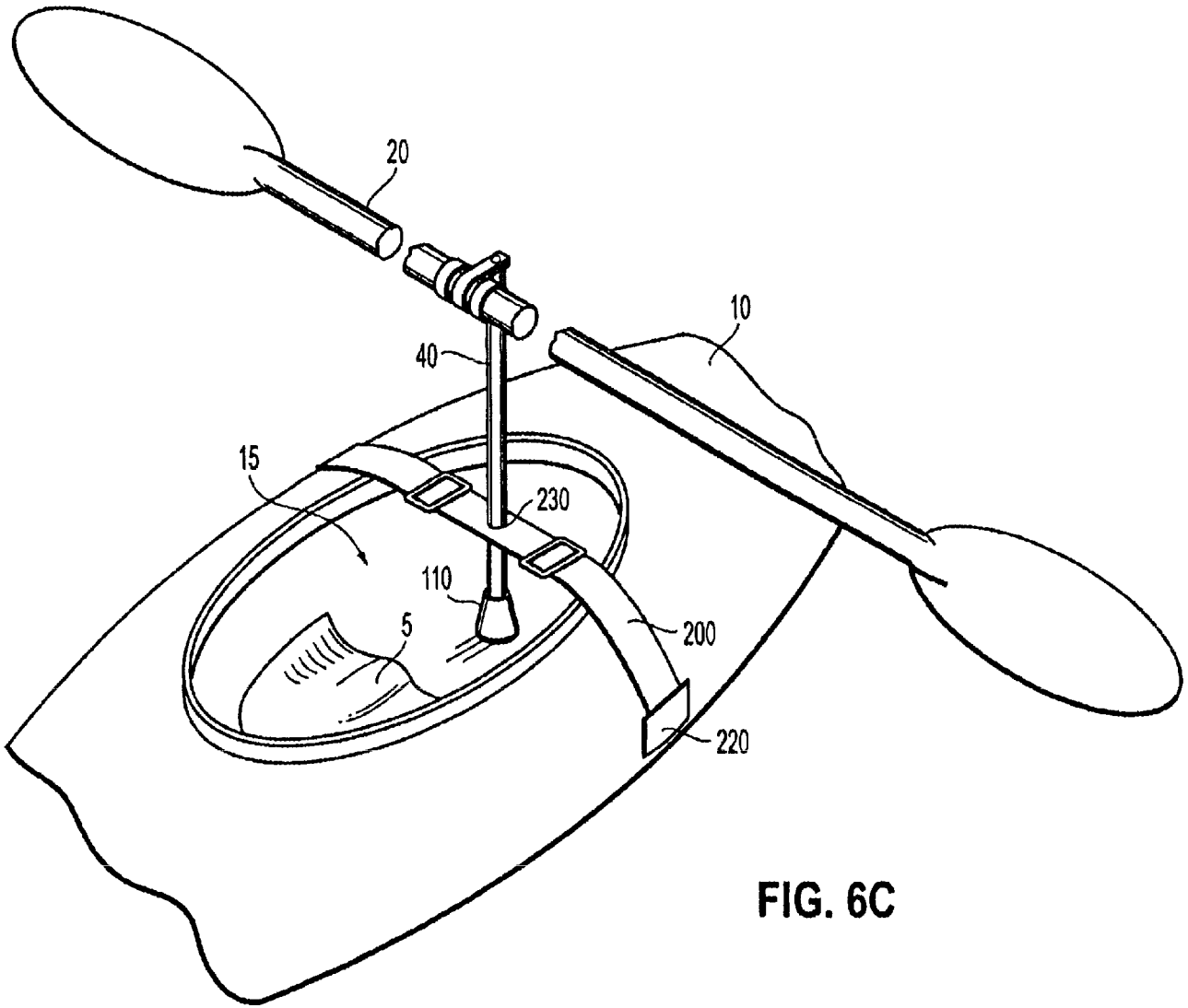
FIG. 6C is an embodiment of the paddle support of this invention with webbing suspended over the opening of a typical vessel.

FIG. 6C is an exemplary embodiment of a paddle 20 installed in the paddle support of this invention on a vessel 10. In this embodiment the support 40 is suspended over the opening of the kayak 15 by the webbing 200, which is attached by the Velcro hook and loop fastener system 220 to the outer portion of the hull of the vessel. By adjusting the webbing 200 to a proper position, the rower, while sitting in seat 5, can support the weight of the paddle 20 and the paddle support of this invention while allowing the use of a skirt over the opening of the vessel. This arrangement allows room for the rower's legs to fit below the webbing. The webbing 200 is a flexible material that allows the support 40 to rotate freely about the mounting hole 230 located in the webbing.

Figure 6D:
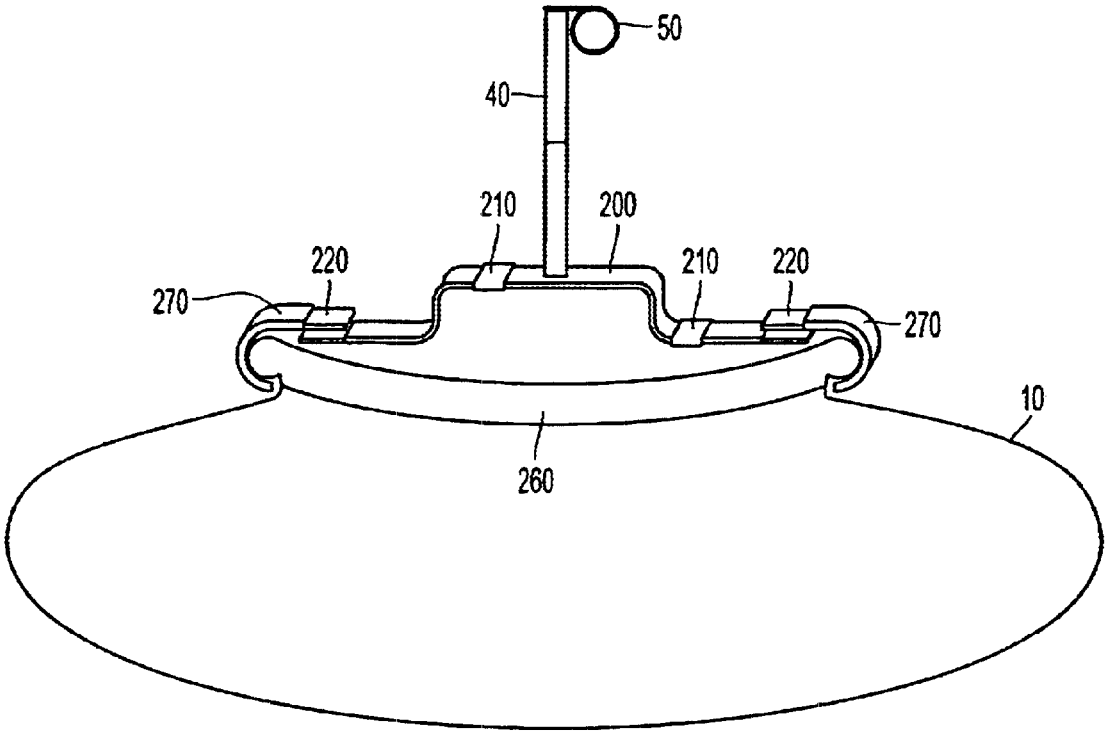
FIG. 6D is another embodiment of the paddle support of this invention having an outside retaining clip mountable to the edge of the vessel which is then attached by hook and loop fastener system to the webbing of the paddle support.

FIG. 6D is an exemplary embodiment of the paddle support of this invention having a retainer 50 mounted on support 40 which is also mounted to the webbing 200. The webbing is adjustable via the two adjustment buckles 210. In this embodiment two outer retaining hooks 270 are attached to the rim of the vessel 260. The outer retaining hooks 270 are secured to the webbing 200 by hook and loop fastener systems 220. This arrangement allows the device to be broken apart to allow a quick exit of the rower in an emergency situation. It also allows the rower to attach the paddle support of this invention to a vessel without attaching a hook and loop fastener system to the vessel itself. In the event that a vessel tipped over, the rower would simply break the hook and loop bond by hand and exit the vessel. The hook and loop bond may also be broken by a sufficient amount of force exerted by any body part. The amount of force required to break the hook and loop bond may be adjusted by varying the area of hook and loop fastener system used with this invention.

Figure 6E:
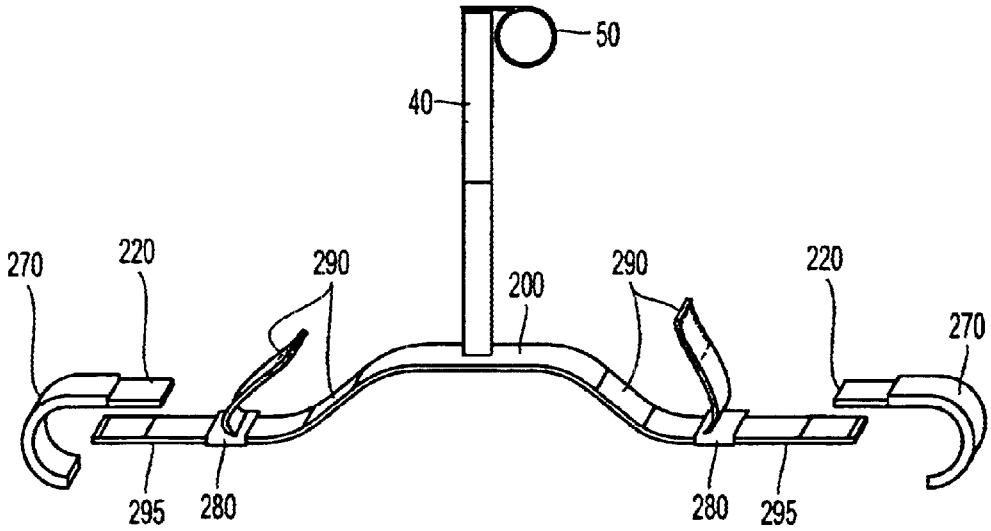
FIG. 6E is another embodiment of the paddle support of this invention having a safety break away system with a separate clamp and hook and loop fastener system.

FIG. 6E is an exemplary embodiment of the paddle support of this invention having a safety break away system. The retainer 50 is mounted on the upright support 40 which is connected to a center portion of the webbing 200. The webbing is adjustable in length via two adjustment clamps 280 and hook and loop fastener systems 290. The webbing 200 is threaded through the adjustment clamps 280 and then folded back on itself and held in place via the hook and loop fastener system 290. In this way the overall length of the webbing 200 may be adjusted. The clamp 280 is secured to an additional section of webbing 295 which is then connected to the retaining hooks 270 via the hook and loop fastener system 220. In the event that a vessel tipped over, the rower would have an added advantage of a second hook and loop fastener system 290 which could be broken to exit the vessel. The amount of force required to break the hoop and loop bond may be adjusted by varying the error or hook and loop fastener system used with this invention. The additional hook and loop fastener system 290 is also advantageous in that it allows a rower to make quick adjustments in the length of the webbing 200 and also eliminates any additional parts that may be needed to adjust the overall length of the webbing 200.

Figure 7A:
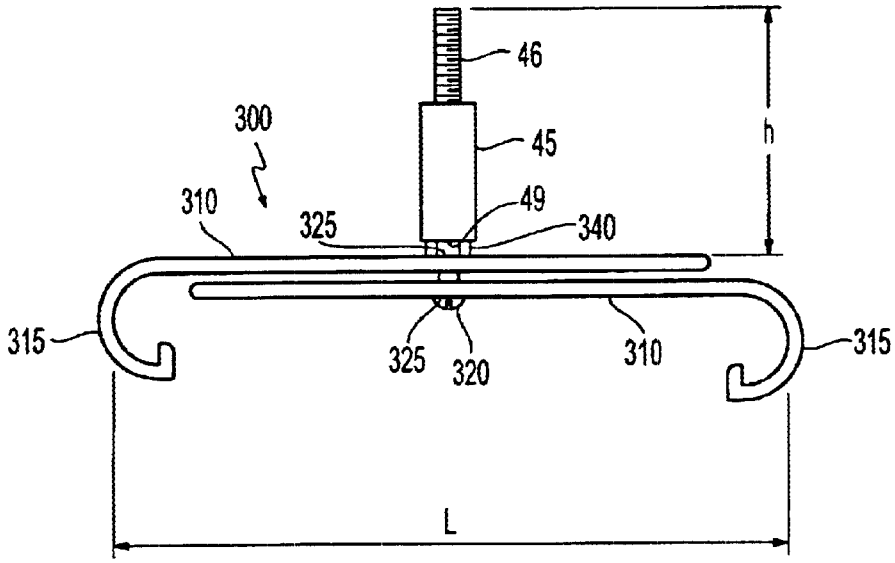
FIG. 7A is an exemplary embodiment of a harness with flexible overlapping plastic plates used for attaching the paddle support to the vessel.

FIG. 7A is an exemplary embodiment of the paddle support 40 of this invention having overlapping flexible plastic harness plates 310 attached to the bottom of the support 40 through two overlapping holes 325 of the corresponding plates 310. The reach -L- of the harness 300 is adjusted by selecting the appropriate overlapping holes 325 and inserting base screw 320 through the holes 325. The harness 300 comprises of a base screw 320 disposed through two overlapping holes 325 of the flexible plastic plates 310 from the bottom side. The flexible plastic plates 310 each have a hooked end 315 used to attach the harness 300 to a rim 260 of a vessel 10. A hexagonal nut 340 is utilized from the top side of the harness 300 to secure the base screw 320 to the harness 300 as well as keep the two flexible plastic plates 310 together. A removable individual modular section 45 of the support 40 is attached by a threaded female connector end 49 to the base screw 320. The threaded male connector end 46 on the top portion of the support 40 can be connected to other support pieces 45 as needed to reach a comfortable height -h- for the rower 30.

Figure 7B:
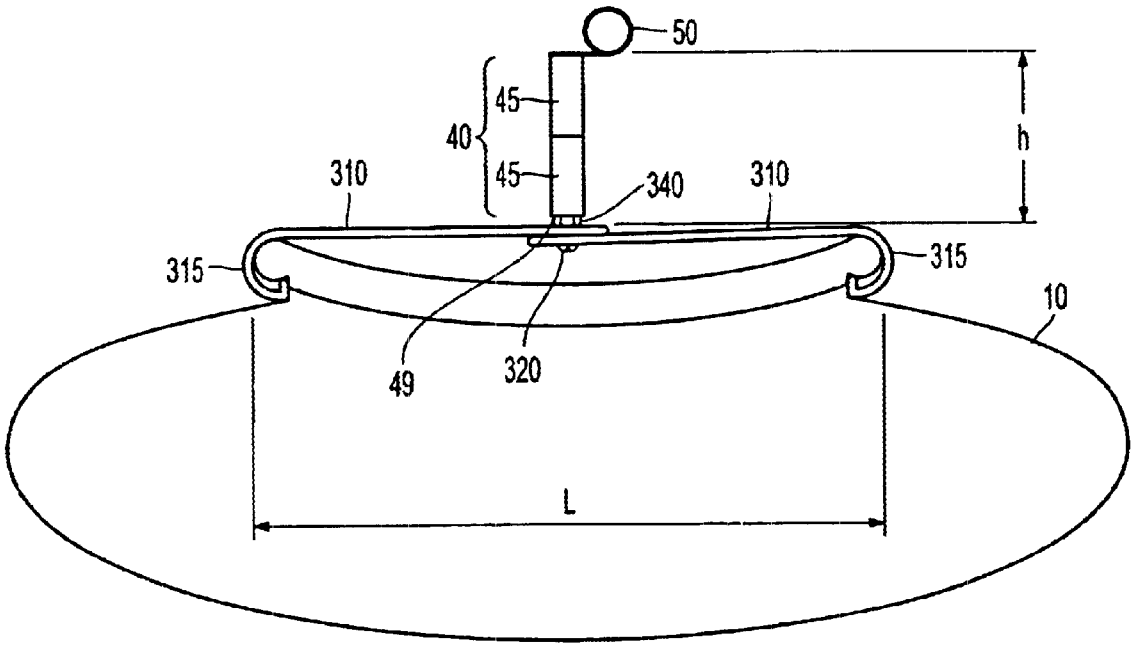
FIG. 7B is an exemplary embodiment of the paddle support of this invention with a harness suspended over the opening of a vessel.

FIG. 7B is an exemplary embodiment of the harness 300 attached to the vessel 10. Furthermore, the harness 300 is attached to the paddle support 40 of this invention which is further attached to the retainer 50 of the invention. The flexible plastic plates 310 are attached by the hooked ends 315 to the rim 260 of the vessel 10. When the appropriate length -L- is determined for the harness 300, the base screw 320 is passed through corresponding overlapping holes 325 of the plates 310. The hexagonal nut 340 is then attached to the base screw 320 from the top side of the harness 300. The threaded base screw 320 is then attached to the threaded female connector end 49 of the removable individual modular section 45. Subsequent support pieces 45 may be added to reach the desired height -h-. Once the desired height -h- is reached, the retainer 50 is attached and finally the paddle 20.

Figure 7C:
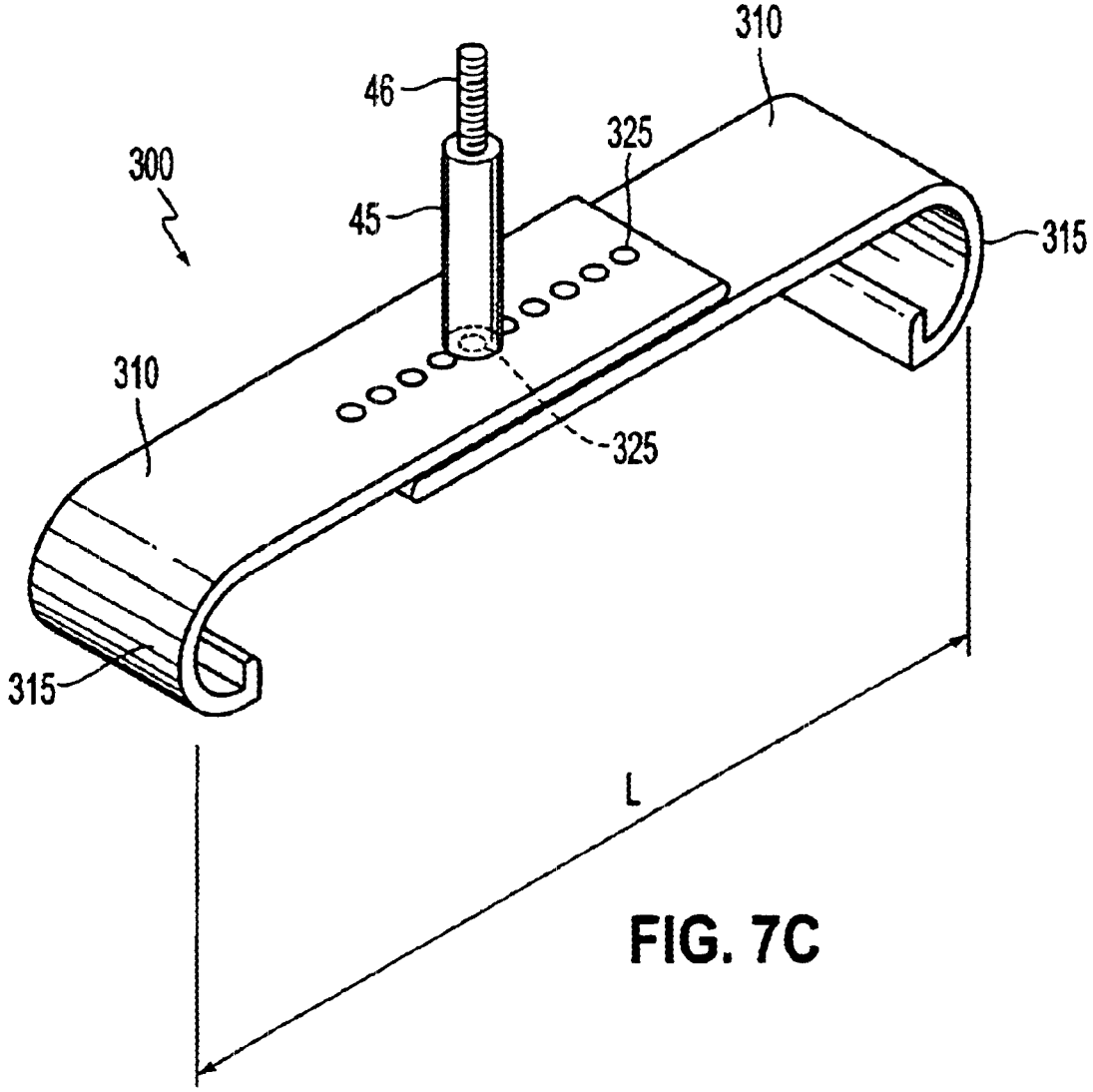
FIG. 7C is a perspective view of the harness showing the overlapping apertures of the individual overlapping plates.

FIG. 7C is an exemplary embodiment of the harness 300 with the overlapping flexible plastic plates 310 to show the overlapping holes 325 which allow length -L- to be adjusted to fit the harness 300 onto various sized vessels 10. The hooked ends 315 of the flexible plastic plates 310 are used to attach the harness 300 to the rim 260 of the vessel. Various overlapping holes 325 can be seen on the top plate 310. Corresponding holes 325 are also located on the bottom plate 310. The base screw 320 is passed through holes 325 and secured by a hexagonal nut 340. The base screw 320 is then attached to the threaded female connector end 49 of the removable individual modular section 45. FIG. 7C shows the removable individual modular section 45 attached with the threaded male connector end 46 of the section 45 open to be attached to other sections 45 to attain the desired height -h-.

Figure 7D:
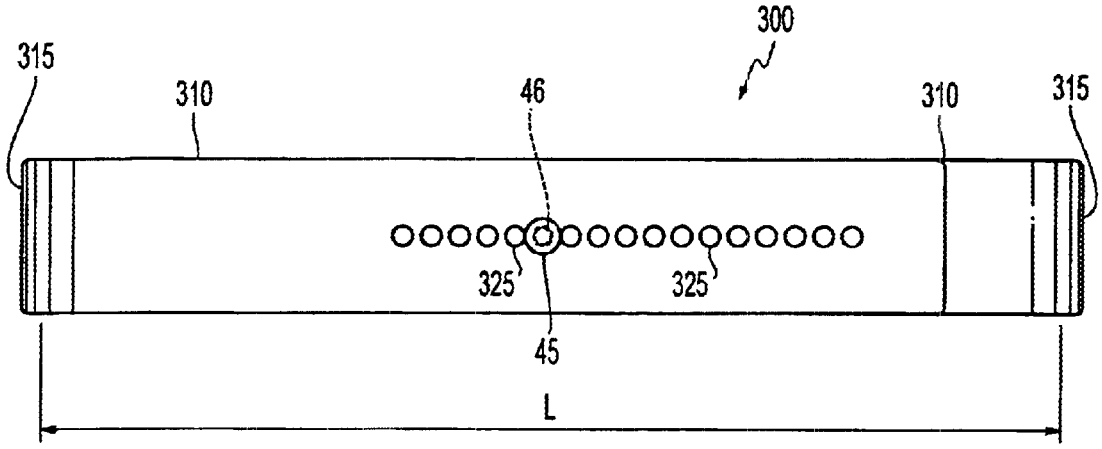
FIG. 7D is an embodiment of the harness as seen from the top further showing the series of holes found on each flexible plastic plate.

FIG. 7D is an exemplary embodiment of the harness 300 with the overlapping flexible plastic plates 310 as seen from a top view. The hooked ends 315 are disposed on both ends of the harness 300. The various holes 325 on the top plate 310 overlap with the holes 325 on the bottom plate 310. On one of the holes 325, the base screw 320 has been inserted and attached to the removable individual modular section 45 having threaded male connector end 46.

Figure 7E:
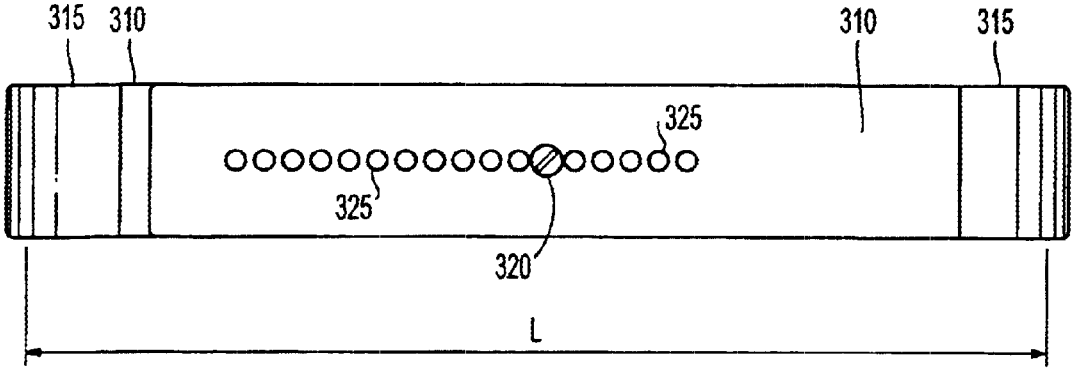
FIG. 7E is an embodiment of the harness as seen from the bottom further showing the series of holes found on each flexible plastic plate.

FIG. 7E is an exemplary embodiment of the harness 300 with the overlapping flexible plastic plates 310 as seen from a bottom view. The hooked ends 315 are disposed on both ends of the harness 300. The various holes 325 on the bottom plate 310 overlap with the holes 325 on the top plate 310. The base screw 320 is inserted through two of the overlapping holes 325.

In operation, the plates 310 are adjusted to the proper length -L-. The hooked ends 315 can be snapped over the rim 260 of the vessel 10. The flexible nature of the plates 310 assists in snapping the hooked ends 315 into place. When the rower 30 desires to remove the harness 300, the rower 30 can lift or kick out the flexible plate 310 by pushing the plates 310 from below. The flexible nature of the plates 310 allows the harness 300 to flex upwardly to release the hooked ends 315 from the rim 260 of the vessel 10.

Figure 8A:
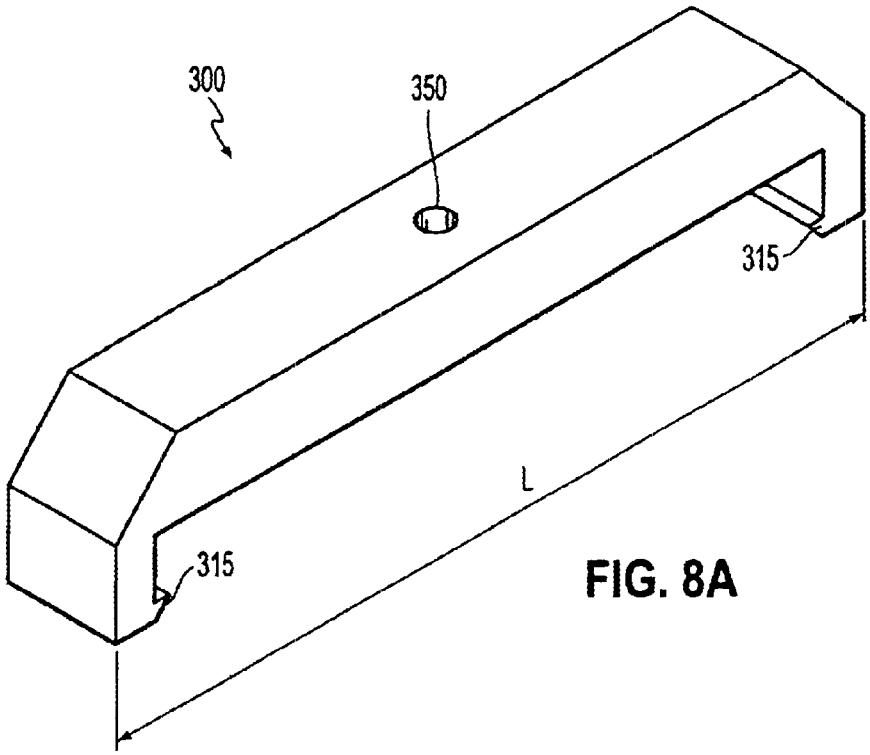
FIG. 8A is an exemplary embodiment of the harness having a non-adjustable length for use with the paddle support of this invention.
Figure 8B:
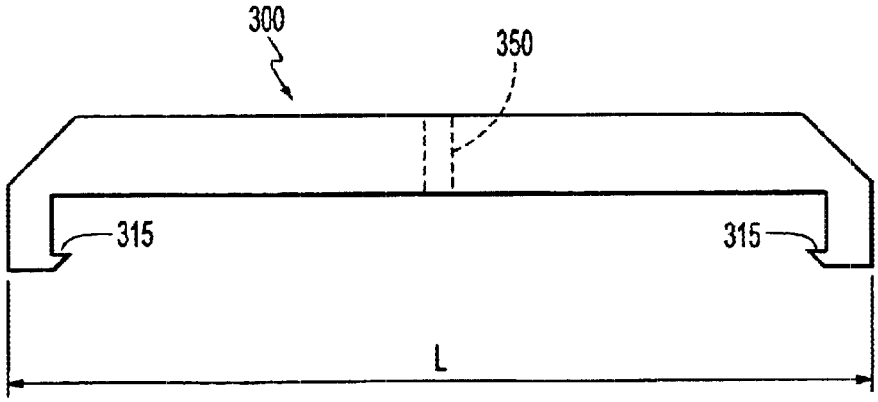
FIG. 8B is a cross-sectional view of the harness shown in FIG. 8A.

FIG. 8A is an exemplary embodiment of the harness 300 having a non-adjustable length -L- for use with the paddle support 40 of this invention. The harness 300 may be constructed of a flexible or rigid material and manufactured in various predetermined lengths to be fitted to the rim of a vessel. The hooked ends 315 allow the harness to be retained on the rim of the vessel. The hooked ends 315 may be of a flexible material to allow the harness 300 to fit over the rim of a vessel, or the hooked ends 315 may be of a rigid material such that the harness 300 may be slid in a longitudinal direction to fit onto the rim of the vessel. The hole 350 accommodates the paddle support and may be retained in place with a base screw on the bottom of the harness and a hexagonal nut on the top of the harness as in previous embodiments. FIG. 8B is a cross-sectional view of the harness 300 having a fixed length -L- with hooked ends 315 and hole 350.

Figure 9A:
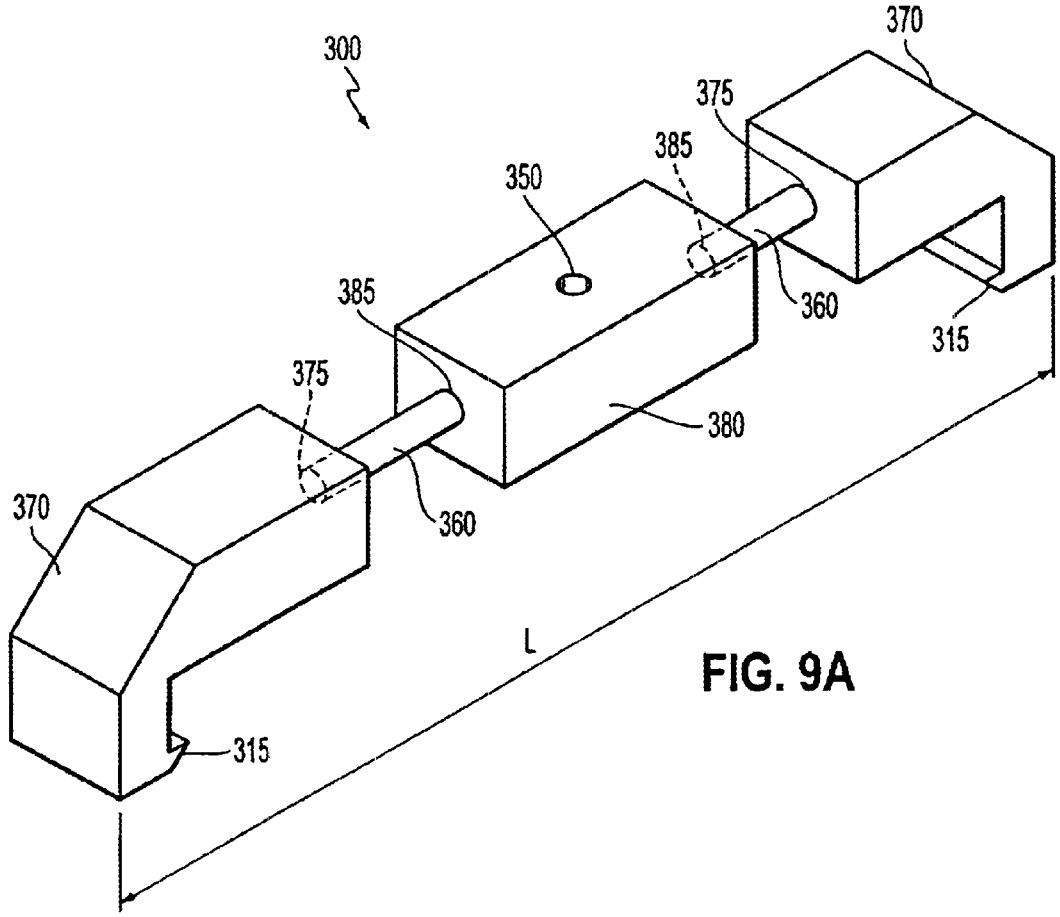
FIG. 9A is an exemplary embodiment of the harness of this invention having end sections slideably connected by dowels to a center section to allow the overall length of the harness to be adjusted.
Figure 9B:
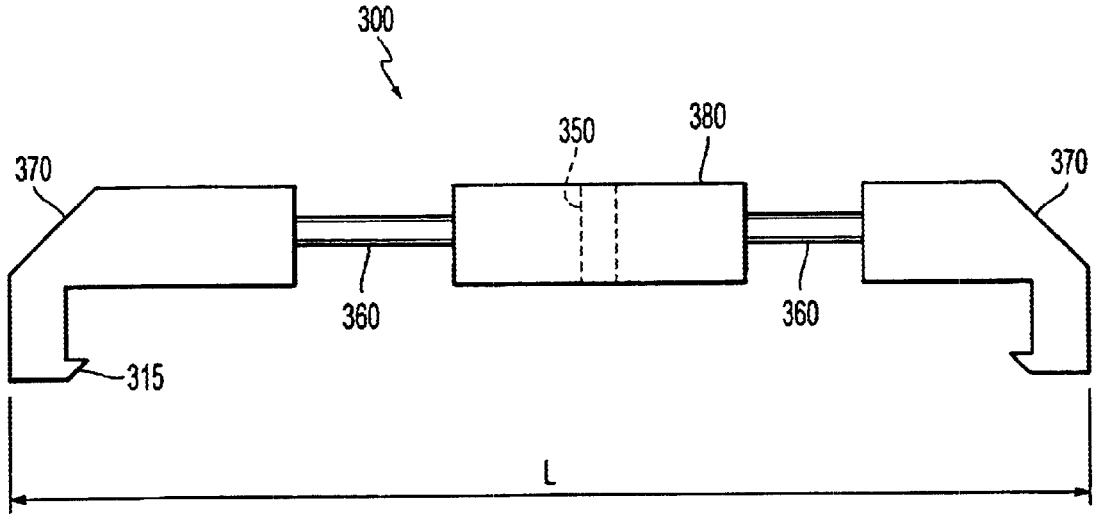
FIG. 9B is a cross-sectional view of the harness as shown in FIG. 9A.

FIG. 9A is an exemplary embodiment of the harness 300 of this invention having an adjustable length -L-. The center section 380 has a hole 350 to accommodate the paddle support. The center section 380 is slideably connected to the end sections 370 by cylindrical dowels. The overall length of the harness 300 may be adjusted by sliding the end sections 370 inward or outward such that the hooked ends 315 engage the rim of the vessel. The center section 380 and end sections 370 may be constructed of a rigid material or of a flexible material. The dowels 360 are slideably connected to the center section 380 and the end sections 370 via holes 385 in the center section and holes 375 in the end sections. FIG. 9B is a cross-sectional view of the harness 300 shown in FIG. 9A.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A kayak paddle support, comprising:

an upright support member of adjustable length;

a retainer at a top portion of the upright support member for retaining a kayak paddle while allowing the kayak paddle to be manipulated in a range of operational motion; and a support strap connected to the upright support member and adapted to connect to sides of a vessel by hook and loop fasteners for suspending the kayak paddle support over a hull of the vessel.

2. The kayak paddle support according to claim 1, further comprising lateral retainers mountable to the kayak paddle to prevent lateral motion of kayak paddle while in the retainer.

3. The kayak paddle support according to claim 1, wherein the upright support member comprises a plurality of sections removably interconnected to allow for overall height adjustment of the kayak paddle support.

4. The kayak paddle support according to claim 3, wherein the sections are removably interconnected by threaded connections.

5. The kayak paddle support according to claim 3, wherein the sections of the upright support are telescopically connected to allow for overall height adjustment of the kayak paddle support.

6. The kayak paddle support according to claim 1, wherein the support strap is fastened to a bottom portion of the upright support member by a threaded male connection passing through the support strap.

7. The kayak paddle support according to claim 1, further comprising hook and loop fasteners mounted on opposite sides of the top portion of the kayak paddle support for securing the support strap when not in use.

8. The kayak paddle support according to claim 1, wherein the overall length of the support strap is adjustable via a hook and loop fastener system.

9. A method of supporting a kayak paddle, comprising the steps of:

adjusting a support strap to a proper length;

fastening the support strap to sides of a vessel;

connecting an upright support to the support strap to suspend the upright support over an opening of the vessel, the upright support including a retainer that receives and supports a kayak paddle; and disposing the kayak paddle on the kayak paddle support.

10. A kayak paddle support, comprising:

an upright support member of adjustable length;

a retainer at a top portion of the upright support member for retaining a kayak paddle while allowing the kayak paddle to be manipulated in a range of operational motion; and a harness of flexible material connected to the upright support member and connectable to a rim of a vessel for suspending the kayak paddle support over an opening of the vessel.

11. The kayak paddle support according to claim 10, wherein the upright support member comprises a plurality of sections removably interconnected to allow for overall height adjustment of the kayak paddle support.

12. The kayak paddle support according to claim 11, wherein sections are removably interconnected by threaded connections.

13. The kayak paddle support of claim 10, wherein the harness is a pair of overlapping plates.

14. The kayak paddle support of claim 13, wherein one end of each plate is a hooked end for attachment to the rim of a kayak.

15. The kayak paddle support of claim 13, wherein the harness is adjustable in length.

16. The kayak paddle support of claim 15, wherein each plate in the pair of overlapping plates includes a series of apertures, the apertures of one plate aligning with the apertures of the other plate, the length of the harness being adjusted by selectively aligning different apertures in each plate.

17. The kayak paddle support of claim 16, wherein the upright support member extends through the aligned apertures in the overlapping plates.

18. The kayak paddle support according to claim 10, wherein the harness is fastened to a bottom portion of the upright support member by a threaded base screw passing through the harness.

19. The kayak paddle support according to claim 10, wherein the harness is a single plate of a non adjustable length.

20. The kayak paddle support according to claim 19, wherein the outer ends of the plate have hooked ends for attachment to the rim of a kayak.

21. A kayak paddle support, comprising:

an upright support member of adjustable length;

a retainer at a top portion of the upright support member for retaining a kayak paddle while allowing the kayak paddle to be manipulated in a range of operational motion; and a harness connected to the upright support member and connectable to a rim of a vessel for suspending the kayak paddle support over an opening of the vessel, wherein the harness comprises a plurality of sections slideably connected by a plurality of dowel sections, the outer most sections having hooked outer ends for attachment to the rim of a kayak.

22. The kayak paddle support according to claim 21, the harness is adjustable in length.

23. A method for supporting a paddle for a vessel, comprising steps of:

adjusting a harness to a proper length;

fastening the harness to the vessel by snapping the flexible hooked ends of the overlapping plates onto the rim of the vessel;

connecting an upright support to the harness to suspend the upright support over an opening of the vessel, the upright support including a retainer for receiving and supporting a paddle; and disposing the paddle on the paddle support.

24. A kayak paddle support, comprising:

a rigid upright support member of adjustable length;

a retainer at a top portion of the upright support member for retaining a kayak paddle while allowing the kayak paddle to be manipulated in a range of operational motion; and a support strap connected to the upright support member and adapted to connect to sides of a vessel for suspending the kayak paddle support over a hull of the vessel, wherein the kayak paddle further comprises a first blade member and a second blade member dispose at opposite ends of an elongated member.

25. The kayak paddle support according to claim 24, further comprising lateral retainers mountable to the kayak paddle to prevent lateral motion of kayak paddle while in the retainer.

26. The kayak paddle support according to claim 24, wherein the upright support member comprises a plurality of sections removably interconnected to allow for overall height adjustment of the kayak paddle support.

27. The kayak paddle support according to claim 26, the sections are removably interconnected by threaded connections.

28. The kayak paddle support according to claim 26, wherein the sections of the upright support are telescopically connected to allow for overall height adjustment of the kayak paddle support.

29. The kayak paddle support according to claim 24, the support strap is connected to left and right sides of the vessel by hook and loop fasteners.

30. The kayak paddle support according to claim 24, wherein the support strap is fastened to a bottom portion of the upright support member by a threaded male connection passing through the support strap.

31. The kayak paddle support according to claim 24, further comprising hook and loop fasteners mounted on opposite sides of the top portion of the kayak paddle support for securing he support strap when not in use.

32. The kayak paddle support according to claim 24, wherein ends of the support strap include a retaining hook connectable to the vessel.

33. The kayak paddle support according to claim 24, wherein the overall length of the support strap is adjustable via a hook and loop fastener system.

* * * * *